United States Patent [19]

Neuendorf

[11] Patent Number: 4,730,703

[45] Date of Patent: Mar. 15, 1988

[54] LOAD LOWERING DEVICE WITH A ROPE OR CABLE DRUM

[75] Inventor: Hans Neuendorf, Balve, Fed. Rep. of Germany

[73] Assignee: AGIMA Innovation & Management AG., Zurich, Switzerland; a part interest

[21] Appl. No.: 25,610

[22] Filed: Mar. 13, 1987

[30] Foreign Application Priority Data

Mar. 22, 1986 [DE] Fed. Rep. of Germany ..... 3609824

[51] Int. Cl.[4] ..... A62B 1/10

[52] U.S. Cl. ..... 182/235; 182/240; 182/72

[58] Field of Search ..... 182/3–7, 182/235, 73, 236, 240, 72, 71, 231; 188/65.1

[56] References Cited

U.S. PATENT DOCUMENTS

| | | | |
|---|---|---|---|
| Re. 28,273 | 12/1974 | Brda | 182/6 |
| 916,823 | 3/1909 | Young | 182/235 |
| 3,703,218 | 11/1972 | Brda | 182/6 |
| 3,759,346 | 9/1973 | Brda | 182/7 |
| 3,807,696 | 4/1974 | Brda | 254/154 |
| 3,915,432 | 10/1975 | Bustamante | 182/240 |
| 4,359,139 | 11/1982 | Bloder | 182/240 |
| 4,603,759 | 8/1986 | Hamada | 182/240 |

FOREIGN PATENT DOCUMENTS 2646368 4/1978 Fed. Rep. of Germany .

*Primary Examiner*—Reinaldo P. Machado
*Attorney, Agent, or Firm*—W. G. Fasse; D. H. Kane, Jr.

[57] ABSTRACT

A load lowering or rescue device for lowering a load or person from an elevated location, has a drum rotatably mounted on a frame. One end of a rope or cable is secured at the elevated location. The other end of the rope or cable is secured to the drum and a portion of the rope or cable is wound around the drum. A spring biased drum brake cooperates with the drum for controlling the lowering speed or for stopping the drum rotation. First and second brake action control members permit controlling the brake action in opposite directions, for example, one control member permits reducing the brake force for accelerating the lowering speed, while the other control member permits selectively increasing the brake force and stopping the lowering. The control members cooperate with a rocker brake lever, and at least one control member cooperates with a lever linkage system connected to the rocker brake lever and to a, preferably spring biased, load attachment device in such a manner that the load being lowered automatically adjusts a spring bias for a constant lowering speed, when the control members are not operated.

7 Claims, 5 Drawing Figures

11
1
4b
30
2
7
4
3
5b
8
6
5
5c
5a
10'
20
20b
20c
17b
17
20a
17c
21
19
9a
18
19a
12
19
1'
19c
13
9
16
10

LOAD LOWERING DEVICE WITH A ROPE OR CABLE DRUM

FIELD OF THE INVENTION

The invention relates to a rope or cable drum device for lowering a load, such as a person, from an elevated location to a lower location. Such devices are, for example, used as safety equipment to rescue persons from dangerous situations.

DESCRIPTION OF THE PRIOR ART

German Patent (DE-PS) No. 2,646,368 discloses a person rescue device of the type mentioned above. Such device includes a frame and a rope or cable drum rotatably mounted in the frame. One end of the rope or cable is adapted to be secured at the elevated location. The other end of the rope or cable is connected to the drum and a portion of the rope or cable is wound around the drum. The rope drum cooperates with a spring biased drum brake which is operable through a rocker type brake lever during the lowering or roping down operation. Two control members such as pull ropes are provided for controlling the brake force in opposite directions. In other words, one pull rope can be used to accelerate the lowering speed by releasing the brake and the other pull rope can be used to slow down the lowering speed or to stop the lowering speed by increasing the braking force.

The rescue device according to German Patent (DE-PS) No. 2,646,368 is capable of assuring a constant lowering speed without any need for activating the drum brake. However, such a constant speed is possible only if the drum brake has been adjusted prior to using the device, to the weight of the particular person to be lowered. Such a brake adjustment is a cumbersome requirement, especially where quick action is of the essence, for example, when a person must be rescued from a burning building.

OBJECTS OF THE INVENTION

In view of the foregoing it is the aim of the invention to achieve the following objects singly or in combination:

to construct a rescue device of the type described in such a way that it will retain the advantages of the prior art device while simultaneously avoiding its disadvantages;

to construct the lowering device in such a way that a person's weight is automatically taken into account for assuring a constant lowering speed regardless of a person's weight attached to the lowering device;

to enable either a rescuer stationed at a lower level or the person that is being lowered to control the lowering speed to either slow it down or permit an increase in the lowering speed or to stop the lowering altogether; and to assure a constant lowering speed even if a spring that takes the size of the load into account, should break.

SUMMARY OF THE INVENTION

A rescue or load lowering device of the type described above is characterized according to the invention in that a rocker brake lever is connected to the person or load through a spring which bears against the frame. This spring is so arranged that the attached load biases the spring in such a way that the spring adjusts the rocker type brake lever into a position applying a smaller brake force to the drum when the load is smaller, and into another position applying an increased brake force when the load is larger.

These features according to the invention make sure that a load, such as a person to be lowered, is first weighed, so to speak, and thereafter the drum brake is automatically so adjusted in accordance with the load or body weight, that a constant lowering speed is assured regardless whether the weight is large or small. It is advantageous to use as the spring which does the weighing, a compression spring, particularly a helical compression spring or a cup spring which is so arranged that it takes the weight of the load into account. Even if the spring should break, a constant lowering speed can be achieved.

According to an especially simple embodiment of the invention, the compression spring is arranged with its effective axis coaxially relative to the direction of load application and so that one end of the spring bears against the frame of the device while a load attaching or supporting member acting as a tension load application element passes through the spring. An upper end of the load application member is secured to the other end of the spring and to the brake lever. The other end of the load application member is secured to the person or load.

In a preferred embodiment, the compression or displacement of the load weighing spring is adapted to the adjustment or displacement range of the rocker type brake lever. For this purpose it is advantageous to connect the load application member through a lever linkage system to the rocker lever, whereby one lever of the lever linkage system is pivoted to the frame of the device.

According to a simplified embodiment of the invention, which still assures a constant lowering speed, a person is enabled to control through the respective control member a continuous or stepless increase of the braking force without being able to effect a slow down, but still being able to cause a complete stop. In other words, the braking force cannot be increased in a stepless manner. This type of operation is quite satisfactory in many instances. Once a complete stop has been caused, the operation can again continue with a constant or increasing lowering speed, for example after releasing an arresting member for the further lowering operation.

The structural components that will be described below are exchangeable against equivalent components. For example, any conventional brake suitable for applying a braking force to the rope drum may be used, different types of control members such as ropes or cables or chains may be used, and springs of one type may be replaced by springs of another type.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
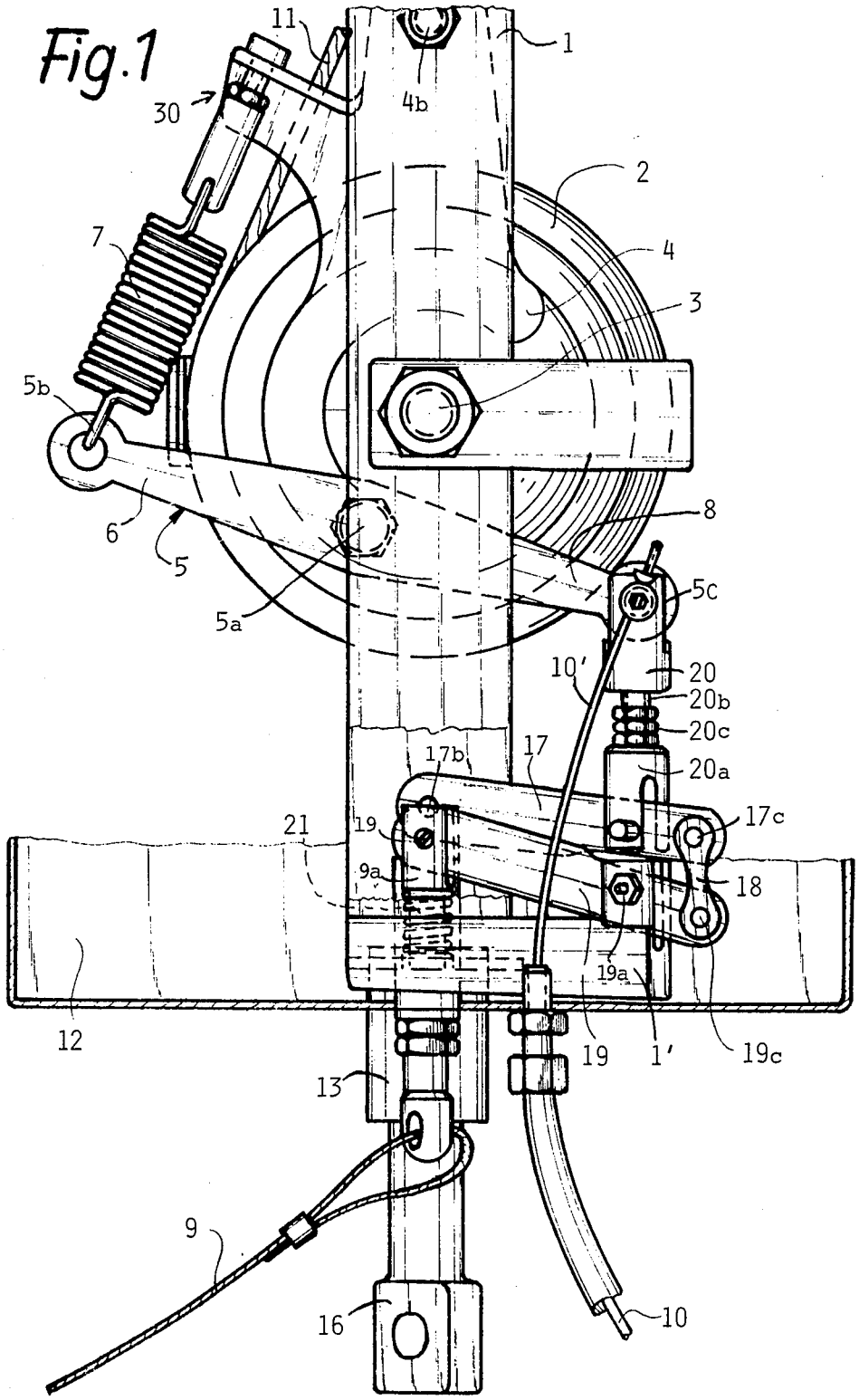
FIG. 1 is a front view of a load lowering device according to the invention.
Figure 4:
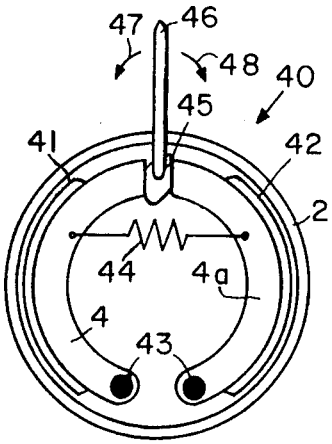
FIG.4 PRIOR ART
FIG. 4 is a conventional dual shoe brake that can be used in a device according to the invention.
Figure 5:
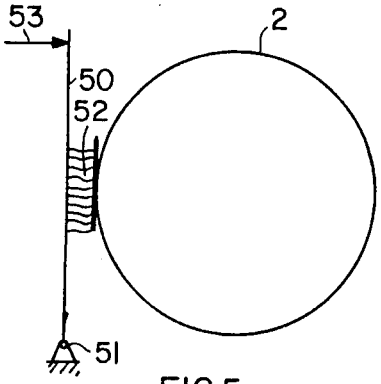
FIG.5 PRIOR ART
FIG. 5 is a conventional friction brake that can be used in a device according to the invention.

Referring first to FIGS. 4 and 5, illustrating examples of conventional brakes suitable for the present purposes, FIG. 4 illustrates a conventional dual shoe brake 40 having two brake shoes 4 and 4a equipped with friction pads 41 and 42 to act radially outwardly against the inner surface of the brake drum 2, also shown in FIG. 1. The brake shoes 4 and 4a are pivoted at 43 to a stationary member not shown. A first spring 44 biases the brake shoes 4 and 4a normally against a brake operating cam 45 and out of contact with the inner surface of the brake drum 2. When the brake operating cam 45 is rotated counterclockwise, for example, with the aid of a shaft 46 as indicated by the arrow 47, the brake pads 41, 42 are pressed against the inner surface of the brake drum 2. Rotation of the shaft 46 in the clockwise direction indicated by the arrow 48 again releases the brake.

FIG. 5 shows a brake application member 50 pivoted at 51 for pressing a friction pad 52 against the brake drum 2 in response to a brake force 53. The member 50 may also be spring biased into a brake release position as is conventional.

Figure 2:
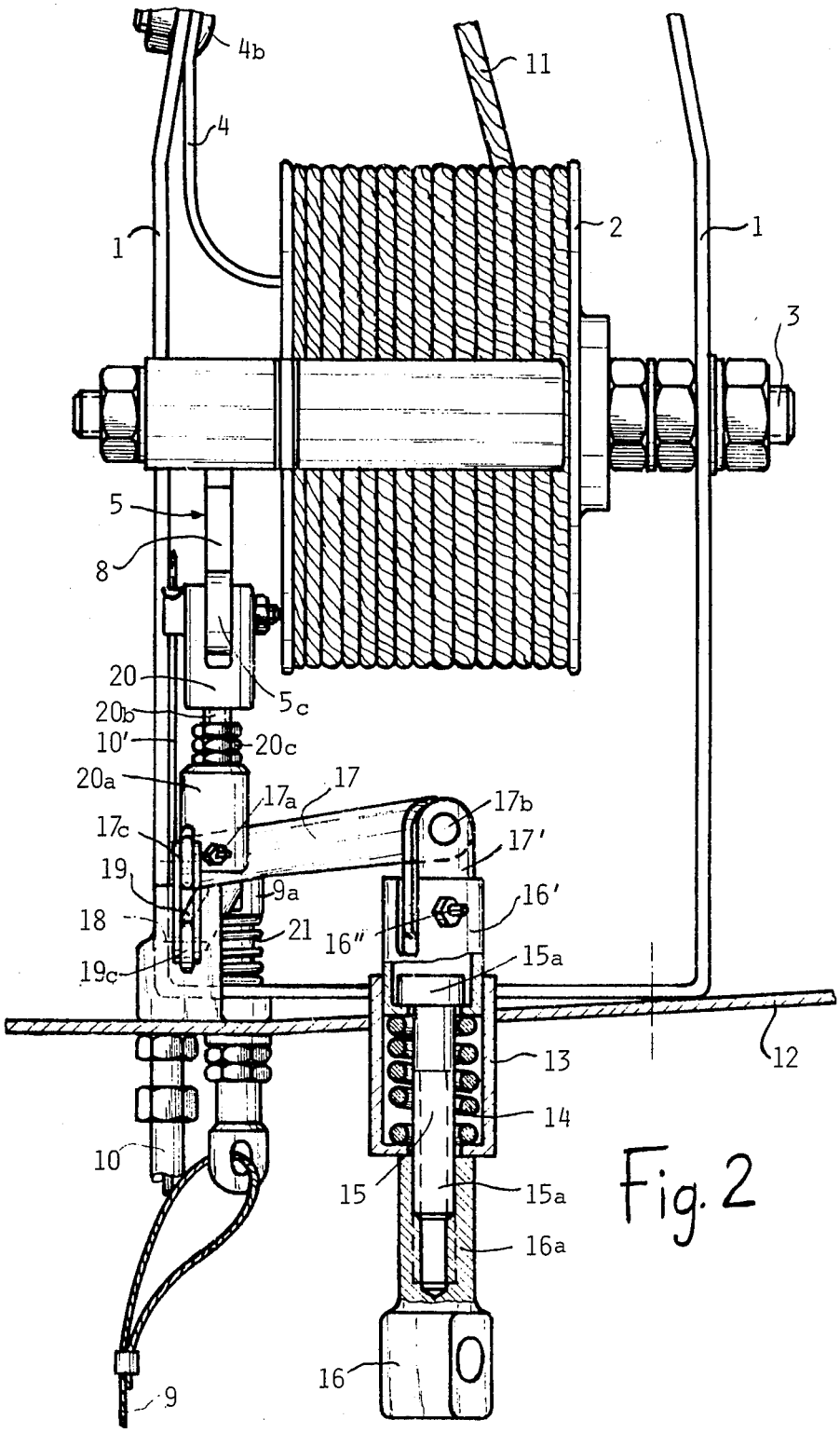
FIG. 2 is a side view of the present device in the direction of the arrow A in FIG. 1.

Referring to FIGS. 1 and 2, the above mentioned brake drum 2 carrying a rope or cable ll, is mounted in a frame 1 for rotation on a stationary axle 3 secured to the frame 1. The details of the friction brake are not shown in FIG. 1 since they are conventional. Only one brake shoe 4 is generally indicated in FIG. 1 and symbolica11y in FIG. 2. The stationary part of the brake is secured to the frame 1, for example, by screws 4b. Thus, the pivots or journals 43 are indirectly secured to the frame 1. The brake shoes 4, 4a are operated as described above by a rocker lever 5 having a fulcrum 5a rigidly secured to the shaft 46 for operating the cam 45. The rocker lever 5 has one arm 6 pivoted at 5b to one end of a spring 7, such as a tension spring, the other end of which is rigidly secured to the frame 1 by adjustable threaded means 30. Thus, the tension of the spring 7 may be adjusted for normally keeping the lever 5 in a rest position in which the brake shoes apply only a small brake force against the spring 44. The other arm 8 of the rocker lever 5 is pivoted at 5c to a pivoting fork member 20 forming part of load attachment means to be described in more detail below.

A first control member 9 such as a steel cable, rope, or chain, is indirectly secured to the end 5c of the rocker arm 8 for releasing the brake shoes from a brake force applying position against the force of the spring 7. For this purpose a lever linkage system is interposed between the first control member 9 and the rocker arm 8 as will be described in more detail below.

A second control member 10 in the form of a conventional Bowden pull is connected with its cable 10' to the free end of the rocker arm 8 for rotating the rocker lever 5 clockwise to thereby apply a brake force to the brake drum 2 either to slow down the lowering speed or to stop the lowering altogether.

The flexible member such as a rope or cable 11 connected to and partly wound onto the brake drum 2 which thus also forms the rope drum, passes with its free end through the upper portion of the frame 1. The free end of the cable or rope 11 has a snap hook for connection at the elevated location. The means for attaching a weight to the device comprise an eye or hook member 16 secured by components presently to be described, to the above mentioned lever linkage system. Thus, a harness, not shown, carrying a person or a load may be secured to the member 16 as is conventional. Preferably, the device is enclosed for protection in a housing 12.

The above mentioned means for attaching a load or person to the device comprise a sleeve 13 rigidly secured to the frame 1, a compression spring 14 forming a second spring, a load application member 15, a forked sleeve 16' slideably received in the sleeve 13 and pivoted to a first lever 17 of a lever linkage system comprising, in addition to the lever 17, a lever 19 and a lever link 18. The lower end of the compression spring 14 bears against the bottom of the sleeve 13 and thus against the frame 1 to which the sleeve 13 is rigidly connected. The upper end of the spring 14 bears against the bottom of the forked sleeve 16'. Thus, the effective force direction of the spring 14 extends vertically and hence coaxially with the load application member 15 having a head 15a received in the forked sleeve 16' and extending through the spring 14 out of the sleeve 13. Thus, the spring 14 is effective between the frame 1 and the head 15a. The load application member 15 has a threaded lower end 15a received in a threaded bore of a shank 16a of the eye or hook member 16. Thus, the eye or hook member 16 together with the load application member 15 is free to move axially and vertically relative to the sleeve 13. In the rest position the spring 14 may pull the upper end of the shank 16a against the lower end surface of the sleeve 13. Depending on the extent to which the member 16 is screwed onto the threaded end 15a, the biasing force of the spring 14 may be adjusted.

The first lever 17 has a floating fulcrum 17a which is pivoted to a forked and threaded sleeve member 20a which in turn is connected in an adjustable manner to the forked and threaded sleeve member 20 through a threaded rod 20b and stop nuts 20c. Thus, the spacing between the pivot 5c and the floating fulcrum 17a is adjustable. The free end of the lever 17 is pivoted at 17b to the forked sleeve member 16' through an intermediate pivot plate 17' and a journal bolt 16''. The other end of the lever 17 is pivoted at 17c to the upper end of a linkage member 18. The lower end of the linkage member 18 is pivoted to the second lever 19 of the linkage system at 19c. The lever 19 has a fulcrum 19a pivotally connected to a frame extension 1', thus providing a fixed fulcrum. The other end of the lever 19 is pivoted at 19b to a forked member 9a conventionally connected to the first control member 9 and movable by a reset spring 21 into a neutral position to hold the second lever 19 in such a neutral position when the control member 9 is not operated. The fork member 9a has a shank passing through a sleeve and connected to the control member 9, whereby the spring 21 bears against the frame 1.

Figure 3:
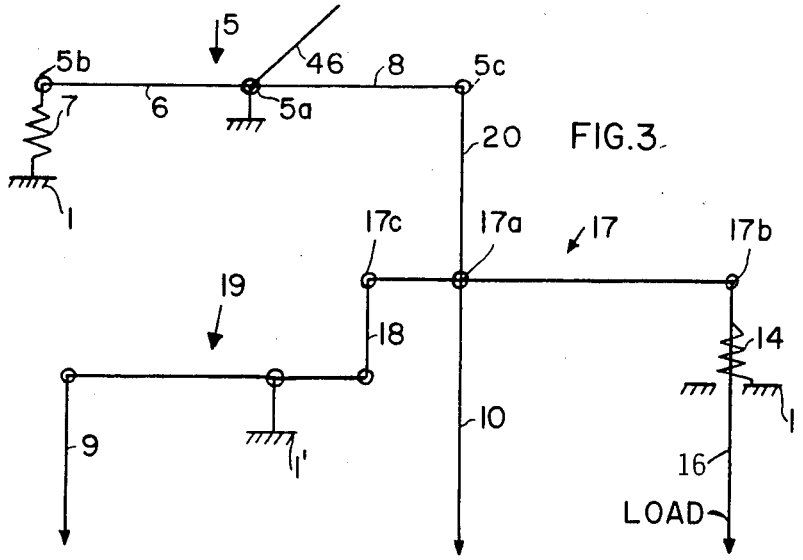
FIG. 3 is a schematic illustration of the lever linkage system of a device according to the invention to describe its operation.

Referring to FIG. 3, the same reference numbers are applied as have been used above in connection to FIGS. 1 and 2. It is assumed that no load is yet applied and that the spring 7 holds the rocker lever 5 in such a position that a slight brake force is applied by the brake shoes to the drum 2. If now a load is applied at 16, the floating pivot point 17a will be moved downwardly to a position determined by the size or weight of the load or person.

Thus, the rocker lever 5 is turned clockwise and more braking force is applied to the drum. However, the lever ratios are so selected that in this condition the load will be lowered at a constant speed since the brake will assure such a constant speed. If the operator wants to increase the lowering speed, he will pull on the control member 9. If the operator wants to decrease the lower speed or stop the lowering, he will pull on the control member 10. In this connection it does not matter whether the upper end of the control member 10 is connected at 5*c* as shown in FIG. 1, or at 17*a* as shown in FIG. 3 because pivot points 5*c* and 17*a* are rigidly interconnected.

Depending on the type of brake used, it is conceivable, that the control member 9 can be used for decreasing the lowering speed and for stopping and the control member 10 could be used for increasing the lowering speed. In that embodiment the rocker lever 5 would turn counterclockwise for the brake application and clockwise for the brake release.

Although the invention has been described with reference to specific example embodiments, it will be appreciated that it is intended to cover all modifications and equivalents within the scope of the appended claims.

What I claim is:

1. A rope or cable drum device for lowering a weight, such as a person, from an elevated location with a controllable lowering speed, comprising a frame, axle means rigidly secured to said frame, a drum rotatably mounted on said axle means, elongated flexible means wound on said drum and having a first end to be secured at said elevated location and a second end secured to said drum, means for attaching a load to said device, brake means operatively connected to said device for controlling said lowering speed of said drum, first spring means for biasing said brake means into a defined state, a rocker type brake lever (5) operatively arranged for cooperation with said brake means, first control means operatively connected to said rocker type brake lever for manually controlling a brake action in one direction, second control means operatively connected to said rocker type brake lever for manually controlling said brake means in an opposite direction, and lever linkage means operatively interposed between said means for attaching a load to said device and said rocker type brake lever, said lever linkage means being also operatively interposed between at least one of said first and second control means for applying a control force to said brake means through said lever linkage means and second spring means arranged between said load attaching means and said frame for counteracting an attached load for influencing said rocker type brake lever in such a way that a load of smaller weight reduces the braking force while a load of larger weight increases the braking force, whereby a constant lowering speed is achieved when said first and second control members are not operated.

2. The device of claim 1, wherein said second spring means comprise a compression spring, such as a cup spring or a helical compression spring.

3. The device of claim 2, wherein said second spring means are arranged coaxially to a load application direction in which a load is effective on said means for attaching a load to said device, said means for attaching a load to said device further comprising a load transmitting member passing through said compression spring for compressing said compression spring in response to a load applied to one end of said load transmitting member, said compression spring having a first end bearing against said frame and a second end cooperating with said load transmitting member for applying a load to said compression spring, and means for connecting the other end of said load transmitting member to said rocker type brake lever for adjusting the brake effectiveness in accordance with the size of a load being lowered.

4. The device of claim 3, wherein said lever linkage means comprise two tilting levers and pivoting means for pivotally journalling said tilting levers (17,19) to said frame, to said load attaching means, and to said rocker type brake lever.

5. The device of claim 4, wherein said lever linkage means comprise a first lever (17) and a second lever (19) for linking said first control means and said load attaching means on the one hand, and said rocker type brake lever (5) and said second control means on the other hand, said first lever (17) having a free end (17*a*) pivoted to said load attaching means for adjusting the brake force in accordance with the size of an attached load, said first lever (17) having a floating fulcrum (17*b*) pivotally connected to said rocker type brake lever (5), rigid pivot link means (18) pivotally connecting a pivot end (17*c*) of said first lever (17) to one end of said second lever (19), fixed fulcrum means (19*b*) pivoting said second lever (19) to said frame, said first control means comprising a pulling member (9) pivoted to the other end (19*a*) of said second lever (19) of said lever linkage.

6. The device of claim 3, further comprising journal means (5*b*) for journalling a fulcrum (5*b*) of said rocker type brake lever (5) to said brake means for operating said brake means.

7. A rope or cable drum device for lowering a weight, such as a person, from an elevated location with a controllable lowering speed, comprising a frame, axle means rigidly secured to said frame, a drum rotatably mounted on said axle means, elongated flexible means wound on said drum and having a first end to be secured at said elevated location and a second end secured to said drum, means for attaching a load to said device, brake means operatively connected to said device for controlling said lowering speed of said drum, first spring means (44) for biasing said brake means into a defined state, a rocker type brake lever (5) operatively arranged for cooperation with said brake means, first control means operatively connected to said rocker type brake lever for manually controlling a brake action in one direction, second control means operatively connected to said rocker type brake lever for manually controlling said brake means in an opposite direction, and second spring means (14) operatively interposed between said means for attaching a load to said device and said rocker type brake lever, said second spring means bearing against said frame for counteracting an attached load and influencing said rocker type brake lever in such a way that a load of smaller weight reduces the braking force while a load of larger weight increases the braking force, whereby a constant lowering speed is achieved when said first and second control members are not operated.

* * * * *